US006619870B2

(12) United States Patent
Furukawa et al.

(10) Patent No.: US 6,619,870 B2
(45) Date of Patent: Sep. 16, 2003

(54) COLLECTOR TYPE WRITING IMPLEMENT

(75) Inventors: Kazuhiko Furukawa, Kanagawa (JP); Yojiro Sano, Tokyo (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/149,586

(22) PCT Filed: Dec. 15, 2000

(86) PCT No.: PCT/JP00/08919

§ 371 (c)(1),
(2), (4) Date: Jun. 14, 2002

(87) PCT Pub. No.: WO01/43984

PCT Pub. Date: Jun. 21, 2001

(65) Prior Publication Data

US 2003/0072601 A1 Apr. 17, 2003

(30) Foreign Application Priority Data

Dec. 16, 1999 (JP) ..... 11-357137

(51) Int. Cl.[7] ..... B43K 5/02

(52) U.S. Cl. ..... 401/224; 401/198; 401/227; 401/199

(58) Field of Search ..... 401/224, 225, 401/227, 228, 198, 199

(56) References Cited

U.S. PATENT DOCUMENTS

| | | | | |
|---|---|---|---|---|
| 4,986,686 A | * | 1/1991 | Yamanaka | 401/224 |
| 5,026,189 A | * | 6/1991 | Keil | 401/198 |
| 5,906,446 A | * | 5/1999 | McCulloch et al. | 401/198 |
| 6,398,442 B1 | * | 6/2002 | Furukawa | 401/227 |

FOREIGN PATENT DOCUMENTS

| | | | |
|---|---|---|---|
| JP | 59-184682 | U | 12/1984 |
| JP | 3-31580 | Y2 | 7/1991 |
| JP | 3-31581 | Y2 | 7/1991 |
| JP | 5-2990 | U | 1/1993 |
| JP | 7-8234 | Y2 | 3/1995 |
| JP | 7-8234 | U | 3/1995 |
| JP | 9-104194 | A | 4/1997 |
| WO | WO 99/56969 | A1 | 11/1999 |

* cited by examiner

*Primary Examiner*—David J. Walczak
(74) *Attorney, Agent, or Firm*—Burns, Doane, Swecker & Mathis, LLP

(57) ABSTRACT

In a writing instrument with a collector of the present invention, an ink absorber made up of a fabric sliver etc., capable of keeping ink therein is disposed inside the ink tank and is connected to the center core, longitudinal groove or the like as an ink feeder portion. The ink absorber is adapted to have a length at least reaching to a position more rearwards than the approximate center of the ink tank and has an outside diameter that is sized to be smaller than the inside diameter of the ink tank so as to create a space around itself for permitting free-state ink to move freely while the collector has a lead portion for establishing connection enabling ink to be led from the ink absorber to the air/liquid exchanger. Specifically, the lead portion of the collector may be configured of a projecting portion directly inserted into and connected with the ink absorber and a lead channel formed on the projecting portion. Alternatively, the lead portion may be formed, instead of being directly inserted to or connected with the ink absorber, by providing an ink lead channel capable of leading ink, which is connected to the center core, longitudinal groove or the like as an ink feeder portion that is connected to the ink absorber.

4 Claims, 8 Drawing Sheets

COLLECTOR TYPE WRITING IMPLEMENT

TECHNICAL FIELD

The present invention is directed to improvement of so-called collector type writing instruments, such as ball-point pens, felt tip pens, markers, fountain pens, small-tube writing instruments and the like, having a writing point at the front end thereof, an ink tank for directly storing ink and a collector or grooved adjuster for absorbing variation in internal pressure. In particular, the present invention relates to improvement of the mechanism to solve the flooding problem occurring when a collector type writing instrument is used under conditions in which a sharp pressure variation occurs such as on an airplane as well as to solve the forward leakage problem occurring when the tip is oriented downward.

BACKGROUND ART

Writing instruments which have a collector 6 as an internal pressure adjuster, disposed between a conventionally existing point assembly 1 and ink tank 3, for retaining free-state ink 2 and adjusting the pressure inside ink tank 3 so as to prevent forward leakage of ink from a tip 9 of point assembly 1 and ink flooding or leakage of ink 2 from an air hole 10 have been known (see FIG. 8).

A collector type writing instrument can adjust the internal pressure balance by holding ink 2 of a relatively low viscosity from ink tank 3 within retaining grooves 13 or fabric element formed as a retaining portion using capillarity, in collector 6 and returning ink to ink tank 3, meaning that it provides the function of protecting point assembly 1 from the influence of changes in pressure.

A collector type writing instrument has excellent performance such as capabilities of providing an ample amount of ink 2, securing the stable amount of ink flow down to the last drop and allowing for the amount of ink 2 left to be checked from the outside.

However, since the collector type writing instruments store ink 2 directly and allow movement in that ink 2 to and from collector 6, there is a serious drawback that ink 2 will flood outside through air hole 10 of the writing instrument there being no space for withholding ink 2, thereby polluting fingers or clothes if the writing instrument is exposed to an environment in which the ink inside collector 6 exceeds the maximum capacity of retention, which is the limitation of the internal pressure adjustment capacity. As the countermeasures for solving this problem or increasing the safety to some degree, it is possible to make collector 6 greater in capacity or make ink tank 3 smaller. There have already been writing instruments sold on the market which use a collector capable of preventing ink flood under usual environments, meaning gentle temperature changes and the like.

As the current situation is that collector type writing instruments use rather thick barrels, taking a safety margin into account, use of a thicker barrel than the present situation makes the instrument difficult to grip and loses the stylishness.

When ink tank 3 is made smaller, reduction of ink stored makes the life short. When collector 6 is made longer, the ink head H becomes higher when the normal collector 6 is made longer because the ink head H acting on point assembly 1 is proportional to the height from the air/liquid exchanger 18 to the tip 9 of writing assembly 1, hence forward leakage of ink 2 from tip 9 occurs.

On the other hand, when a writing instrument which has been capped under about 1 atm. on the ground and is uncapped inside an airplane in which the air pressure is generally reduced to about 0.8 atm., the interior of the pen which has been balanced under 1 atm., is instantaneously exposed to an environment of about 0.8 atm., so ink 2 inside moves in a rush and floods the space around the air channel 15 of collector 6, whereby ink 2 floods out from air hole 10, being unable to be properly retained by the whole part of retaining grooves 13.

In order to solve the flooding problem occurring under conditions in which the air pressure varies, devices and inventions have been disclosed in Japanese Utility Model Publication Hei 3 No.31580, Japanese Utility Model Publication Hei 3 No.31581 and Japanese Patent Application Laid-open Hei 9 No.104194, and others.

However, these disclosures only provide the function of blocking the flush to directly reach the air hole, which is not efficient enough, hence a further effective improvement or other ways to reach a solution have been demanded.

Further, since collector type writing instruments have the problem that the life of writing abruptly ends when ink 2 runs out, it is necessary to carry a spare if the writing instrument has a low amount of ink. There is a demand for collector type writing instruments which can provide an ample amount of ink, which is the main feature of collector type writing instruments, until nearly the end of writing and can provide the performance of a fabric sliver type instrument, which delivers gradually reducing amounts of ink, for a short time so that the pen can be used to take some notes after the last drop of ink 2 is used up. There is another problem of ink dropping from the writing point making it difficult to write when the pen has been kept upside down for long time. Further, even when an equal amount of ink is loaded, a collector type writing instrument delivers a greater amount of ink than a conventional fabric sliver type writing instrument and hence has a shorter life. Therefore, there is a demand that downsizing of the ink tank volume should be avoided as far as possible.

As the solution to the aforementioned ink drop problem and the like, devices and inventions as to writing instruments having a fabric sliver or sponge therein have been disclosed in Japanese Utility Model Application Sho 59 No.184682, Japanese Utility Model Application Laid-open Hei 5 No.2990 and Japanese Utility Model Publication Hei 7 No.8234, and others.

These mainly aim at the means for a solution of the ink drop problem. When the pen is used for writing under conditions in which free-state ink 2 is used up while an ample amount of ink 2 resides in the sponge or the like, air enters into tank 3 through air/liquid exchanger 18. In this situation, when writing with the pen has been stopped and it is left with its tip downward (in a state of rest taking while writing), it happens that ink 2 remains fed to point assembly 1 from the sponge or the like, despite the fact that no free-state ink stays at air/liquid exchanger 18 and hence no reduction in internal pressure due to a meniscus occurs.

Since, in this state, head HS of ink 2 from tip 9 to the upper end of the sponge is applied on tip 9 of point assembly 1, forward leakage of ink 2 from tip 9 is liable to occur. This situation is almost equivalent to a case where the space of the fabric sliver of a conventional sliver type writing instrument is filled up with ink up to fully 100%. For actual, conventional sliver type writing instruments, ink is initially loaded only up to about 80% so as to avoid this situation.

When an ink absorber 31 such as sponge, fabric sliver or the like is inserted into a free-ink collector type writing instrument, the above situation, that is, the 100% ink loaded state, will inevitably occur in the process of ink 2 being consumed. Therefore, if an ink absorber 31 consisting of a small fabric sliver etc. is used as the countermeasure against sharp changes in pressure, which is the main object of the present invention, a solution to this problem should be also found.

It is therefore a main object of the present invention to provide improvement of collector type writing instruments of prevalent configurations. In detail it is a main object of the present invention to provide a writing instrument which, without the necessity of a special configuration limiting the usage, can avoid crucial accidents such as pollution of consumer's clothes and fingers, due to forward leakage of ink 2 from tip 9 of point assembly 1 or due to flooding of ink 2 from air hole 10 exceeding the limit of the pressure adjustment capacity of collector 6, by alleviating the variation in pressure inside ink tank 3 resulting from change in temperature or air pressure.

There has been a demand for solution to the defect of collector type writing instruments, i.e., the liability to cause flooding especially when they are used on an airplane or under an environment in which sharp temperature change occurs. Therefore a further enhanced writing instrument can be obtained if an inexpensive collector type writing instrument with the above problem removed can be provided while the appearance and writing distance (life) are kept as before, if a solution to the forward leakage problem under the situation where no free-ink remains while an ample amount of ink 2 remains within ink absorber 31 is solved, and if the end of writing life problem and ink drop problem can be solved.

DISCLOSURE OF INVENTION

In general, collector type writing instruments include ball-point pens, fountain pens, small-tube writing instruments and the like which have an ink feeder core (center core 8, collector core, and the like) for assuring the flow path of ink 2 having a low viscosity (100 mP·s or lower) from an ink tank 3 to a writing point 9 provided at the tip of a point assembly 1 or which have an ink feeder portion made up of a slit (in the case where a vertical groove 14 is extended to the tip) and the like in a collector 6, and felt tip pens, markers and the like in which ink feeder core (7, 8) itself serves as a writing tip 1. Hereinbelow, ink feeder cores (center core 8, collector core 7, etc.) will also include those which themselves serve as pen tips.

Arranged between ink tank 3 of a cup-like shape having a bottom integrally formed or assembled with a separate part such as a tail plug or the like and a point assembly is a collector 6, which may be formed of a plurality of retaining grooves 13 (generally, gaps defined by a plurality of vanes 12), an air groove 15 connected to the external air and a narrow longitudinal groove 14 creating communication between retaining grooves 13 or which may be made up of surface treated fibers, so as to retain ink 2 using capillarity. An air/liquid exchanger 18 of a small enough size is provided for collector 6 and is adapted to be wetted with ink 2, so that ink tank 3 can be isolated from the external air and air will not enter ink tank 3 from the outside other than through air/liquid exchanger 18.

In the present invention, the above-stated typical configuration of a collector writing instrument is provided while, as an effective means of the present invention, an ink absorber 31 made up of a fabric sliver, sponge, fiber bundle, foamed material, or the like capable of retaining ink is incorporated in ink tank 3 and connected to center core 8, collector core 7 or longitudinal groove 14, in order to lead ink 2 from the interior of ink tank 3 to writing point 9 of point assembly 1.

Since, while free-state ink 2 remains in ink tank 3, ink 2 from center core 8, collector core 7 and the front and rear ends of ink absorber 31 flows in, the same writing performance as a conventional collector writing instrument can be obtained.

When free-state ink 2 is used up, the writing performance becomes close to that of a conventional sliver type configuration. To avoid spoiling the excellent writing comfort of a free-ink type collector type writing instrument, it is preferred that appropriate countermeasures such as reducing the ink absorber 31 in size, setting the capillary capacity of ink absorber 31 lower than that of center core 8 and collector core 7, or other methods are taken.

Ink absorber 31 is configured so that its length at least reaches to a position more rearwards than the approximate center of ink tank 3 and its diameter is sized so as to create a space around itself for permitting free-state ink 2 to move freely while it can absorb ink 2 at least from both the front and rear ends.

As ink absorber 31, a fiber bundle core which is formed by bonding or forming ordinary fibers with adhesives or with heat, a fabric sliver made up of soft fibers covered by a cladding, a shaped mass of foamed sponge and others can be used.

In order to use ink 2 efficiently and to avoid spoiling the excellent writing comfort of a free-ink type collector type writing instrument, necessary methods such as reducing the capillary capacity lower than that of center core 8 and collector core 7 may be employed as appropriate.

As an effective configuration of the present invention, an ink lead portion 39 which permits ink 2 absorbed in an ink absorber 31 to flow to an air/liquid exchanger 18 when free-state ink 2 is used up is provided for a collector 6. Specifically, lead portion 39 is configured so as to be able to provide capillary capacity by a combination of an ink lead channel 40 and other parts, and is arranged to connect between ink absorber 31 and air/liquid exchanger 18.

Lead portion 39 may be inserted into the front end part of ink absorber 31 or may be configured so as to lead ink in an indirect manner by its being brought into contact with collector 7, center core 8 or the like that serves as an ink feeder portion from ink absorber 31 to writing point 9, instead of being directly connected to ink feeder 31.

BEST MODE FOR CARRYING OUT THE INVENTION

Figure 1:
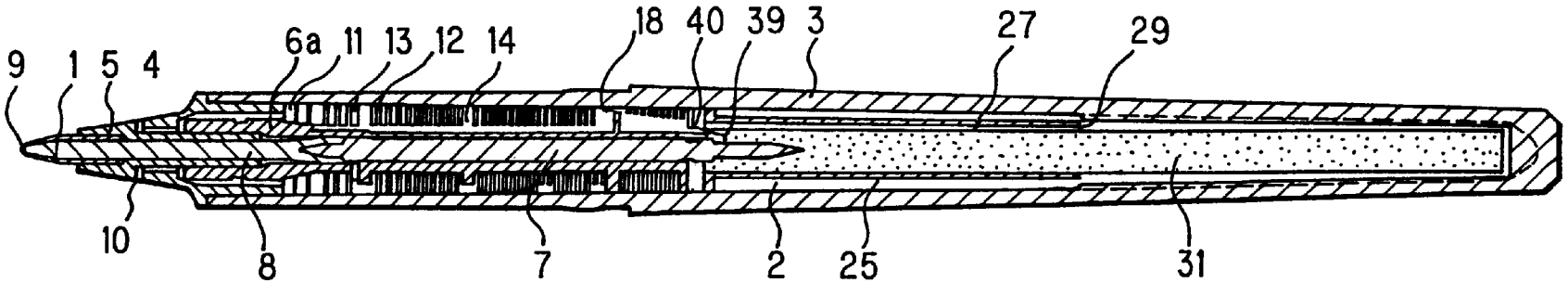
FIG. 1 a vertical sectional view showing the whole writing instrument of the first embodiment according the present invention.

Now, the illustrated examples will be detailed. Here, the same components as those described above are allotted with the same reference numerals without description.

As shown in the drawings, the writing instrument of the first embodiment of the present invention is a ball-point pen comprised of a point assembly 1 having a ball as a writing point 9 at the tip and an ink feeder portion made up of a center core 8 and a collector core 7 serving as an ink feeder core for establishing the flow passage of ink 2 from an ink tank 3 to writing point 9. Here, examples of the ink feeder core (center core 8, collector core 7 and the like) may include one which itself serves as a pen tip.

As point assembly 1, pen tips of various types of writing instruments can be used as already mentioned.

A collector 6, which is composed of vanes 12 defining retaining grooves 13 therebetween and a narrow longitudinal groove 14 for establishing ink communication between an air groove 15 connected to the outside and each retaining groove 13, is arranged between cup-like ink tank 3 integrally formed with a bottom and point assembly 1, forming a so-called collector type writing instrument.

Figure 8:
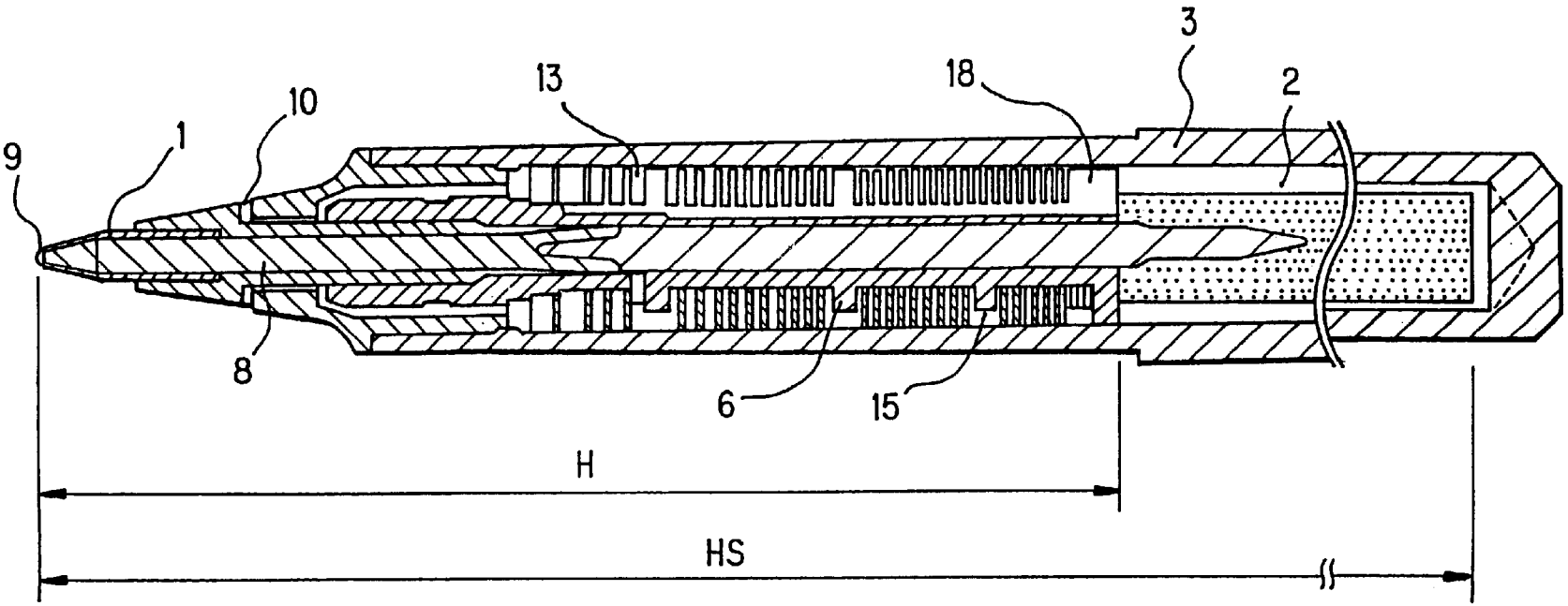
FIG. 8 PRIOR ART
FIG. 8 is a vertical sectional view showing a conventional writing instrument body.

As shown in FIG. 8, in a conventional collector type writing instrument, free-state ink 2 is stored inside ink tank 3 while air/liquid exchanger 18, which is provided in collector 6 and is small enough, is wetted with ink 2, so that ink tank 3 is isolated from the external air and air will not enter ink tank 3 from the outside other than air/liquid exchanger 18. Other components such as a plastic mouthpiece 5, joint 4, cap (not shown), ink 2 and the like should not be limited particularly by the present invention, and conventional items can be selected and used as appropriate. Similarly, for ink 2, any ink can be used and selected as appropriate as long as it can be used for collector typewriting instruments. Examples include: inks based on a solution which can be used for writing instruments, such as water, alcohols, xylene, various glycolic solvents, various glycol etheric solvents and other solvents, inks containing pigments, organic pigments or dyes as coloring agents and inks having some viscosity or pseudo-plasticity.

In the collector writing instrument, when the internal pressure inside ink tank 3 varies, ink 2 may enter retaining grooves 13 of collector 6 by way of air/liquid exchanger 18 or air may enter tank 3 by way of air/liquid exchanger 18 so as to keep the balance of the internal pressure, whereby almost no pressure other than the ink head H acts on the interior of point assembly 1 while the meniscus at air/liquid exchanger 18 functions to practically keep the pressure in the ink tank 3 side lower than the external pressure to prevent forward leakage from point assembly 1.

When a plurality of retaining grooves 13 are provided, there grooves may be joined by narrow longitudinal groove 14, or a collector 6 may be formed by fibers having been processed through a water-repellent treatment or the like.

When the amount of ink 2 in ink tank 3 is reduced by ink consumption for writing to a level slightly greater than the maximum retention of the collector, variation in internal pressure in ink tank 3 becomes maximum. Therefore, the design is made so as not to cause flooding of ink 2 from air hole 10 by filling the collector with ink 2 in case air expansion or contraction inside tank 3 occurs due to increase or decrease in external air pressure or change in temperature.

Generally, a correlation between the volume of an ink tank 3 and the maximum ink retention amount i of a collector 6 has been known. Usually, the writing instrument is conventionally designed so that the maximum ink retention volume is about 10 to 30% of the ink tank volume.

It is possible to improve the safety margin as to flooding if the proportion of the maximum ink retention volume i to the size of ink tank 3 is increased. However, if collector 6 is made too long, the ink head H acting on the point assembly 1 becomes too high, posing the forward leakage problem from the point assembly.

If collector 6 is made too large in diameter, the barrel size becomes too thick, causing difficulties in gripping and influence on its external appearance or stylishness.

If ink tank 3 is made smaller, the amount of ink decreases, resulting in short writing distance.

For these reasons, extra auxiliary retaining grooves 17 are formed in addition to main retaining grooves 16 as shown in FIG. 1 so as to increase the retaining volume of the collector without increase of ink head H.

Figure 2:
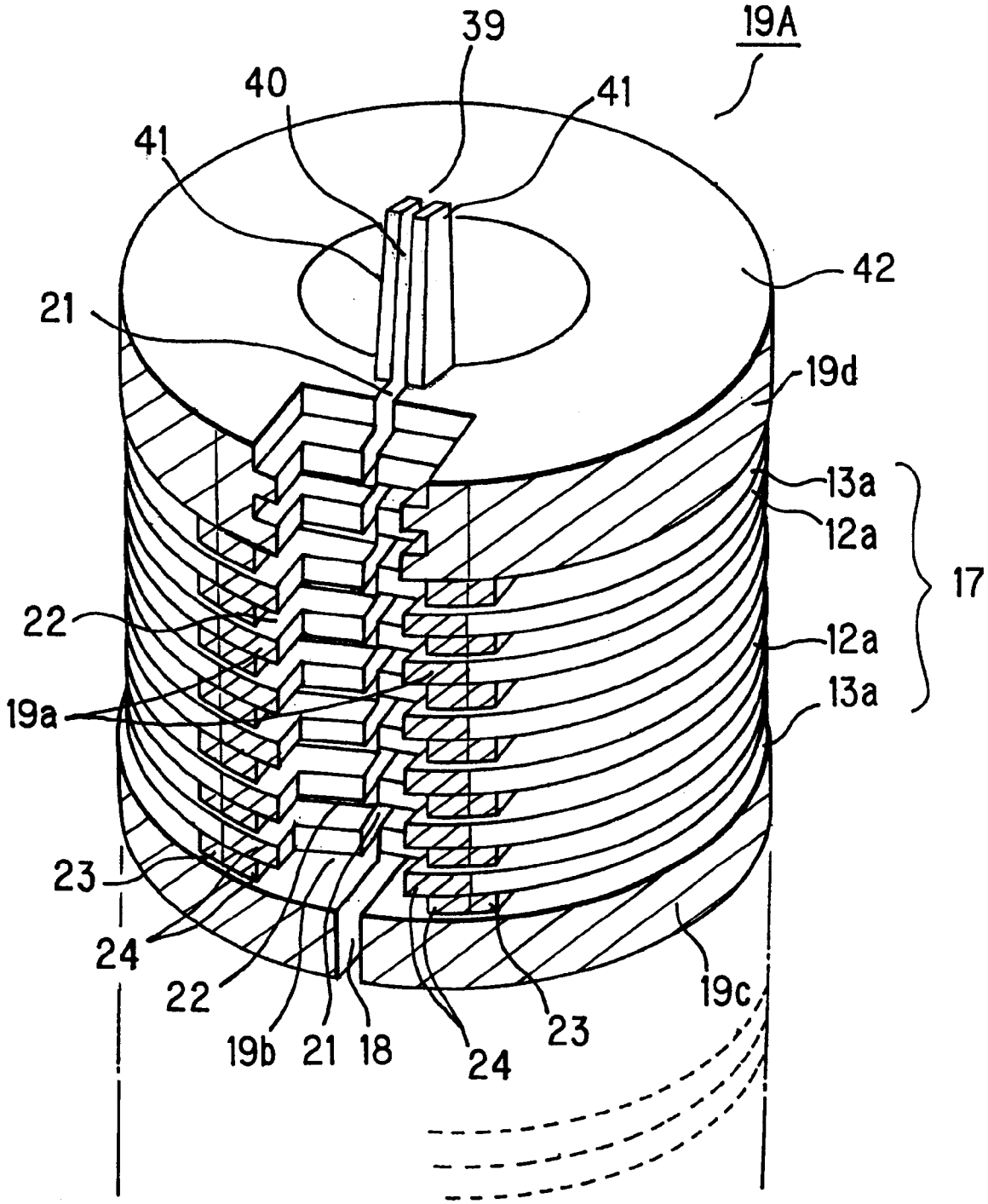
FIG. 2 is a perspective view showing auxiliary retaining grooves 17 portion of a collector of a writing instrument of the first embodiment of the present invention.

FIG. 2 is a perspective view showing auxiliary retaining grooves 17 portion (partitioning portion 19).

Auxiliary retaining grooves 17 are formed in partitioning portion 19A in order to increase the ink retention.

Partitioning portion 19A is constructed of a frontmost partitioning portion 19*c* formed with air/liquid exchanger 18, a rearmost partitioning portion 19*d* confronting ink tank 3 and extended partitioning portions 19*a* for connection between the frontmost partitioning portion 19*c* and rearmost partitioning portion 19*d*. The part with hatching shown in FIG. 2 (FIG. 5) is wetted with ink 2 and hence shut off from external air. Exchange of air with the ink tank is made through air/liquid exchanger 18.

A plurality of fin-like vanes 12*a* protruding upright like flanges are formed at regular intervals on the outer peripheral surface in the range of auxiliary retaining grooves 17 and define retaining grooves 13*a* by the gaps therebetween. In the present embodiment, six vanes 12*a* are provided at regular intervals, constituting auxiliary retaining grooves 17.

Partitioning portion 19A and air/liquid exchanger 18 (groove or hole) is wetted with ink 2 so that the interior of ink tank 3 is substantially shut off from external air. For air replacement during writing, air/liquid exchanger 18 alone serves for air replacement.

Partitioning structure 19A may be formed by a part or combination of parts having no intentional grooves or holes. Alternatively, the partitioning portion may be formed with a part or parts having fine grooves or holes, as long as their dimensions are small enough compared to the dimensions of air/liquid exchanger 18, so that once the parts have got wetted with ink 2 no air replacement will be permitted therethrough or substantial confinement can be assumed to be established.

Formed in the space enclosed by extended partitioning portions 19*a*, rearmost partitioning portion 19*d* and frontmost partitioning portion 19*c* is an enclosed portion 19*b* which constitutes a channel that permits air bubbles entering by air replacement to move from air/liquid exchanger 18 to the ink tank side 3 side.

Enclosed portion 19*b* is formed of a relatively wide groove or cutout or hole for permitting air bubbles arising from air replacement to move to the ink tank 3 side, and preferably has a configuration which is usually filled up with ink 2 when the writing instrument is put with its pen tip down. The enclosed portion 19*b* of the present embodiment is configured so as to form a space which gradually increases its depth in the radial direction of collector 6*a* as it approaches from the air/liquid exchanger 18 side to the ink tank 3 side. This arrangement of enclosed portion 19*b* so formed that the areas of opening become gradually greater from the air/liquid exchanger 18 side to the ink tank 3 side, enables air bubbles arising at air/liquid exchanger 18 to move to the ink tank 3 side more smoothly compared to the configuration where the areas of opening are made uniform.

Further, enclosed portion 19*b* is formed with lateral grooves 22 and a narrow groove 21 which leads ink 2 towards air/liquid exchanger 18.

Since narrow groove 21 provides almost the same functions, i.e., introduction and connection of ink 2, as narrow longitudinal groove 14 connected to main retaining groove section 16 does, it can be formed with dimensions and configuration similar to those of longitudinal groove 14, but may be formed by a cutout or hole defined by combination of parts as long as it can provide the function of leading ink 2 to lateral grooves 22.

Further, in order to lead ink 2 from lateral grooves 22 into retaining grooves 13*a,* partitioning portion grooves 23 having almost the same width as retaining groove 13*a* are formed on the outer peripheral surface of extended partitioning portions 19*a*.

In order to lead ink 2 from narrow groove 21 to partitioning portion grooves 23, lateral grooves 22 for connection between narrow groove 21 and partitioning portion grooves 23 are formed in enclosed portion 19*b*.

Lateral groove 22 may be formed by a groove, cutout, hole, clearance defined by a plurality of parts, or any other structure and shape, which provides the function of creating communication of ink 2 led from the ink tank 3 side via narrow groove 21 with auxiliary retaining grooves 17, as long as it can practically lead ink 2 to auxiliary retaining groove section 17.

Further, in the present embodiment, in order to make ink flow smoothly from the enclosed portion 19*b* side to the auxiliary retaining groove section 17 side, the edges of extended partitioning portions 19*a* are cut off so as to form chamfers 24.

Chamfers 24 are formed so that the size of the opening becomes smaller as it goes from the enclosed portion 19*b* side to the auxiliary retaining grooves 17 side.

In the present embodiment, the inkhead H is the difference in height from air/liquid exchanger 18 to writing point 9 of point assembly 1. That is, the ink head is the same as conventional collector type writing instruments, hence no forward leakage, or ink leakage from writing point 9 will occur.

The capacity of adjustment when the air space inside ink tank 3 expands or contracts, namely the maximum ink retention amount i of collector 6*a* is increased by the maximum ink retention amount ie of the auxiliary retaining grooves compared to the conventional collector 6. Therefore, the resultant collector type writing instrument is improved in its capability to deal with variation in pressure and change in temperature.

The ink lead and discharge arrangement, aiming at establishing communication between auxiliary retaining grooves 17 of the present invention and ink 2 inside ink tank 3, constituted by narrow groove 21, lateral grooves 22, partitioning portion grooves 23 and the like, enables ink 2 in ink tank 3 to flow into auxiliary retaining grooves 17 and main retaining grooves 16 of collector 6*a,* simultaneously if a sharp variation in pressure occurs. In sum, unlike the conventional configuration in which all ink 2 would flow in a rush and flood out by way of only air exchanger 18, ink may also flow into auxiliary retaining grooves 17, thus making it possible to alleviate the rushing flow.

Further, the arrangement of auxiliary retaining grooves 17, lateral grooves 22, partitioning portion grooves 23 and narrow groove 21 assures that ink 2 will flow into auxiliary retaining grooves 17 when a sharp reduction in external air pressure occurs as stated above, whereby it is possible to reduce the amount of ink flowing into main retaining grooves 16 as well as weakening the power of the rushing flow.

Moreover, when a sharp increase in external air pressure occurs, the ink 2 held in auxiliary retaining grooves 17 can return to ink tank 3 owing to the arrangement of auxiliary retaining grooves 17, lateral grooves 22, partitioning portion grooves 23 and narrow groove 21, in an easier manner than ink returns through air/liquid exchanger 18. Therefore, even if increase and decrease in pressure is further repeated, the ink retention volume of collector 6*a* capable of retaining ink 2 can be easily recovered so that it is possible to increase the permissible margin against flooding.

Since partitioning portion 19A has a rather irregular configuration, there are cases where the collector end face may dry when the device is assembled or when it has been set with its tip up for a long period. In such a case, it happens that this part becomes difficult to be wetted with ink 2 immediately. In order to reliably wet this part with ink 2 and practically shut off ink tank 3 from external air, narrow groove 21 for leading ink and lateral grooves 22 and partitioning portion grooves 23 connected to the narrow groove to enable ink to reach auxiliary retaining grooves 17 are provided, whereby the entire partitioning portion 19A gets wetted with ink 2 once narrow groove 21 gets wetted with ink 2.

Conventionally, if a collector type writing instrument is used while travelling by air, on the ground under about 1 atm. and in an airplane during flight in which the air pressure is assumed to be about 0.8 atm., repeatedly, ink moves in a rush into collector 6 and may flood out, being unable to be properly retained, or if the outside air pressure abruptly increases, only air may enter tank 3 while ink 2 in collector 6 will not return to tank 3.

In particular, after repetition of such cycles, ink 2 gradually accumulates and fills retaining grooves 13 of collector 6, and at last, ink may flood out due to a slight temperature rise such as of body temperature. A solution to this drawback has been demanded.

The inventor hereof has already completed an invention, which can produce the effect of reducing the volume of air space (to be referred to hereinbelow as 'volume reduction effect') when it grows in ink tank 3 as ink 2 is consumed, without reducing the retention of ink 2, by providing ink absorber 31 in ink tank 3, and which provides a structure which can weaken ink flush. The first means of the present invention is a further enhancement of this prior invention.

As the configuration, ink absorber 31 made up of a fabric sliver etc., needs to be arranged so that its length reaches to the approximate center of ink tank 3 or a further rear, in order to produce the volume reduction effect.

Further, in order to take advantage of one of the benefits of free-ink type writing instruments, that is, the feature that the amount of ink left in ink tank 3 can be viewed from the outside, it is necessary for ink 3 to freely enter or leave at least a sector formed around ink absorber 31. For this reason, the shape of ink absorber 31 is made adequately smaller than the inside diameter of ink tank 3.

An effective feature of the present invention resides in that a lead portion 39 is provided for collector 6*a* so that the range from ink absorber 31 to air/liquid exchanger 18 can be persistently wetted with ink 2.

Lead portion 39 can be integrally formed with collector 6*a* or may also be provided by a combination of separate parts. A fiber bundle or gaps created by a combination of parts may be used to provide capillarity as long as it can have the function of wetting air/liquid exchanger 18. That is, it should not be particularly limited as long as it can have the function of leading ink.

In the first embodiment of the present invention, lead portion 39 is integrally formed with collector 6*a* while a horned projecting portion 41 having a lead channel 40 are formed so as to be inserted into the front end part of ink absorber 31.

Provision of projecting portion 41 makes it possible for ink 2 in ink absorber 31 to flow into air/liquid exchanger 18 of collector 6*a* with point assembly 1 set downward when free-state ink 2 inside ink tank 3 is used up and when ink 2 is stored virtually to fully 100% in ink absorber 31. As a result, a meniscus can be formed at air/liquid exchanger 18, whereby it is possible to prevent forward leakage because the ink head acting on point assembly 1 can be equalized to the ink head H acting when free-state ink 2 is stored.

While the amount of ink 2 stored exceeds the retaining capacity of ink absorber 31, capillary capacity arising at lead channel 40 acts because lead portion 39 of the present invention is put in contact. Further, ink 2 will naturally flow from lead portion 39 to air/liquid exchanger 18 due to gravity when point assembly 1 is oriented downwards.

As ink 2 is further consumed, ink absorber 31 will not flow ink 2 to lead portion 39 because of a reduced amount of ink charged therein, but in this state, ink absorber 31 has a high enough capability to hold ink, or the ink absorber is able to avoid forward leakage of ink 2 in the same mechanism as the conventionally existing sliver type does. Therefore, it is possible to prevent forward leakage of ink 2 from tip 9 of point assembly 1.

Ink tank 3 may usually employ materials which can inhibit evaporation of ink 2, for example, transparent polypropylene (PP) and the like when ink is of a water-based one. Lead portion 39 of the present invention may be integrally molded with collector 6 from plastic or may be formed as a separate part and joined to collector 6.

When lead portion 39 is given as a separate part from collector 6, any of ink-resistant materials such as PP, ABS, PET, PE, metals etc., can be used for lead portion 39, depending on its purpose. When it is given as a separated part, in order to improve its wettability it is usually and preferably reformed by a conventionally known plasma treatment or subjected to a surface treatment with acid or alkali, wettability reforming coating treatment or the like.

In the embodiment of the present invention, a snorkel 25 having a vent portion 27 is provided in order to release air from tank 3 increased in pressure, whereby it is further possible to reduce the occurrence of flooding.

Figure 3:
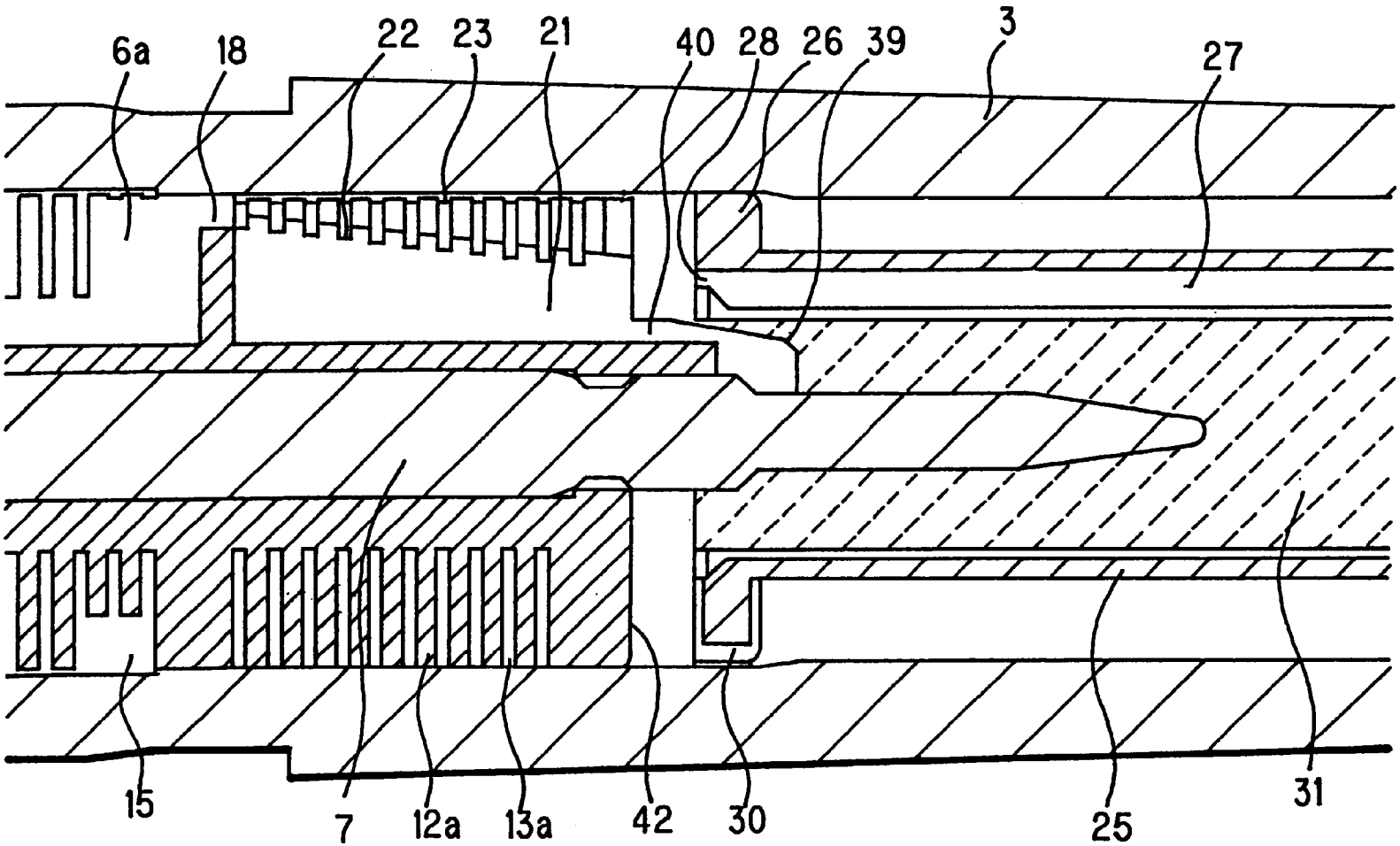
FIG. 3 is an enlarged vertical sectional view showing the center portion of a writing instrument according to the first embodiment of the present invention.
Figure 4:
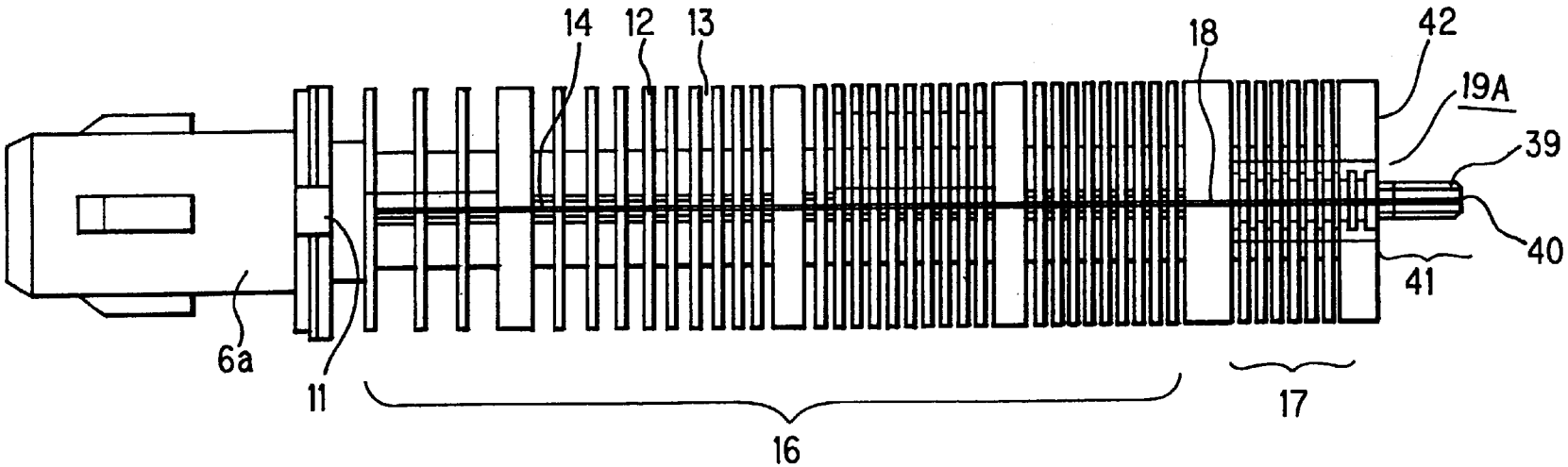
FIG. 4 is a plan view showing the appearance of a collector of a writing instrument according to the first embodiment of the present invention.

Snorkel 25 is composed of a sectioning portion 26 for separating ink tank 3 and a vent portion 27 forming an air path that creates air communication between a front opening 28 arranged at the rear end 42 side of collector 6*a* and a rear opening 29 (FIG. 1) arranged at the approximate center of ink tank 3 or more rearwards as shown in FIG. 3.

When rear opening 29 of snorkel 25 is arranged at the approximate center of the portion where free-state ink 2 is stored (at around the centroid of the portion where ink is stored if an asymmetrical tank is used) in ink tank 6, this provides the optimal configuration when taking the balance between the prevention against flooding when the device is set downward and the mobility of air bubbles arising during writing.

Sectioning portion 26 is press fitted against the inner wall of ink tank 3 so as to practically separate ink tank 3 into a front tank 37 and rear tank 38. Sectioning portion 26 is formed with a single ink conduit 30 which is formed of a groove or hole sufficiently small compared to the size of vent portion 27. Ink conduit 30 may be formed on the inner wall side of ink tank 3 or on both the sectioning portion 26 side and the inner wall side of ink tank 3. Also, ink conduits 30 may be formed at a plurality of sites.

This provision of snorkel 25 makes it possible, when the device with a reduced amount of ink is set with its point assembly 1 down, for ink 2 in ink tank 3 to move from the rear tank 38 side divided by sectioning portion 26 to the front tank 27 side by way of ink conduit 30. That is, ink tank 3 is separated by sectioning portion 26, however, these sections are actually not isolated from each other because of the presence of ink conduit 30. Therefore, this arrangement permits continuous writing as well as allowing ink 2 to move into the collector 6 side. Thus, provision of snorkel 25 enables collector 6*a* to exhibit sufficient ink retaining capability when the air pressure and temperature change in a moderate manner. The collector with which the effect of snorkel 25 of the present invention can be achieved should not be particularly limited. The same effect can be obtained if the snorkel is applied to the conventional collector 6.

In order to achieve the writing comfort of a collector type writing instrument (especially, the feature that an ample amount of ink flows out until its life end), ink absorber 31 is formed of about half the amount of the fabric sliver used in a typical conventional sliver type writing instrument so as to weaken its capillary capacity to a low enough level, whereby the flow amount of ink will not gradually lower from writing like the conventional sliver type does. Usually, ink 2 in ink absorber 31 is likely to leave ink absorber 31 from its being dropped or other events. However, unlike the conventional sliver type configuration, there is no problem with this configuration if free ink flows out into ink tank 3. This is why the above setups are permitted.

In the above way, a further applied mechanism or setup maybe added to the present invention, and there is no particular limitation as to additional mechanisms and settings.

The lead portion 39 of the above first embodiment is configured so that horned projecting portion 41 is inserted into the front end part of ink absorber 31. However, the same effect can be obtained when projecting portion 41 of lead portion 39 is put in contact with the front end of ink absorber 31, or are arranged close to, with a micro clearance apart that permits lead of ink, the front end of ink absorber 31, in a virtually connecting manner.

Next, the second embodiment of the present invention will be explained.

In the second embodiment, a lead portion 39*a*, which is integrally formed with collector 6*a* or provided by a combination of separate parts, is not directly connected or inserted to ink absorber 31 but is configured to lead ink 2 stored in ink absorber 31 to air/liquid exchanger 18, in an indirect manner.

Specifically, a collector core 7 is interposed between air/liquid exchanger 18 and ink absorber 31 so as to establish connection for ink leading.

As a specific configuration, a lead portion 39*a* is formed by a projecting portion 41*a* that has a lead channel 40 in a slit form, and this lead channel 40 is put into contact with, or are arranged close to, with a micro clearance apart that permits lead of ink, collector core 7 (or center core 8 or the rear end of point assembly 1), in a virtually connecting manner.

Figure 5:
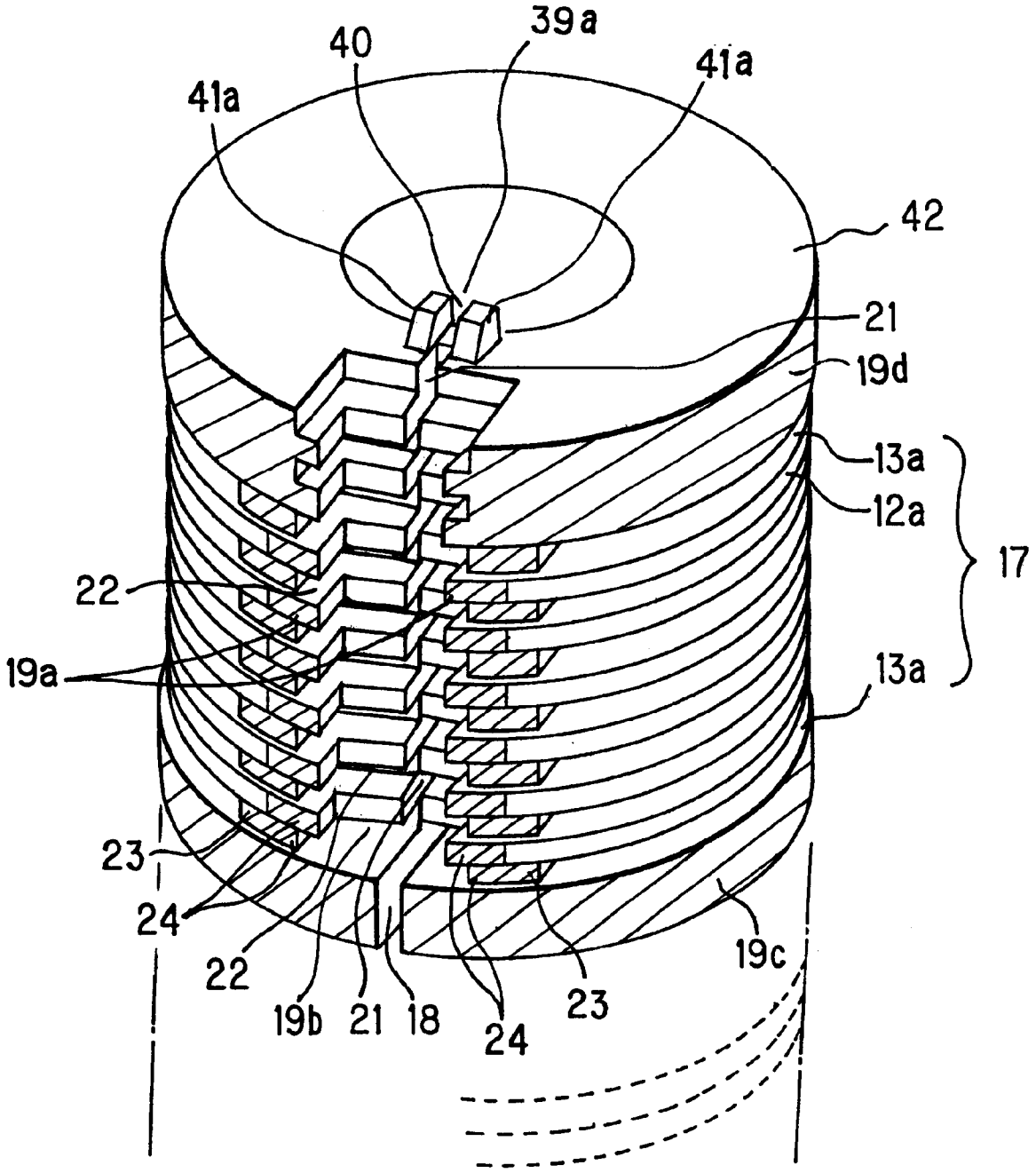
FIG. 5 is a perspective view showing auxiliary retaining grooves 17 portion of a collector of a writing instrument of the second embodiment of the present invention.
Figure 6:
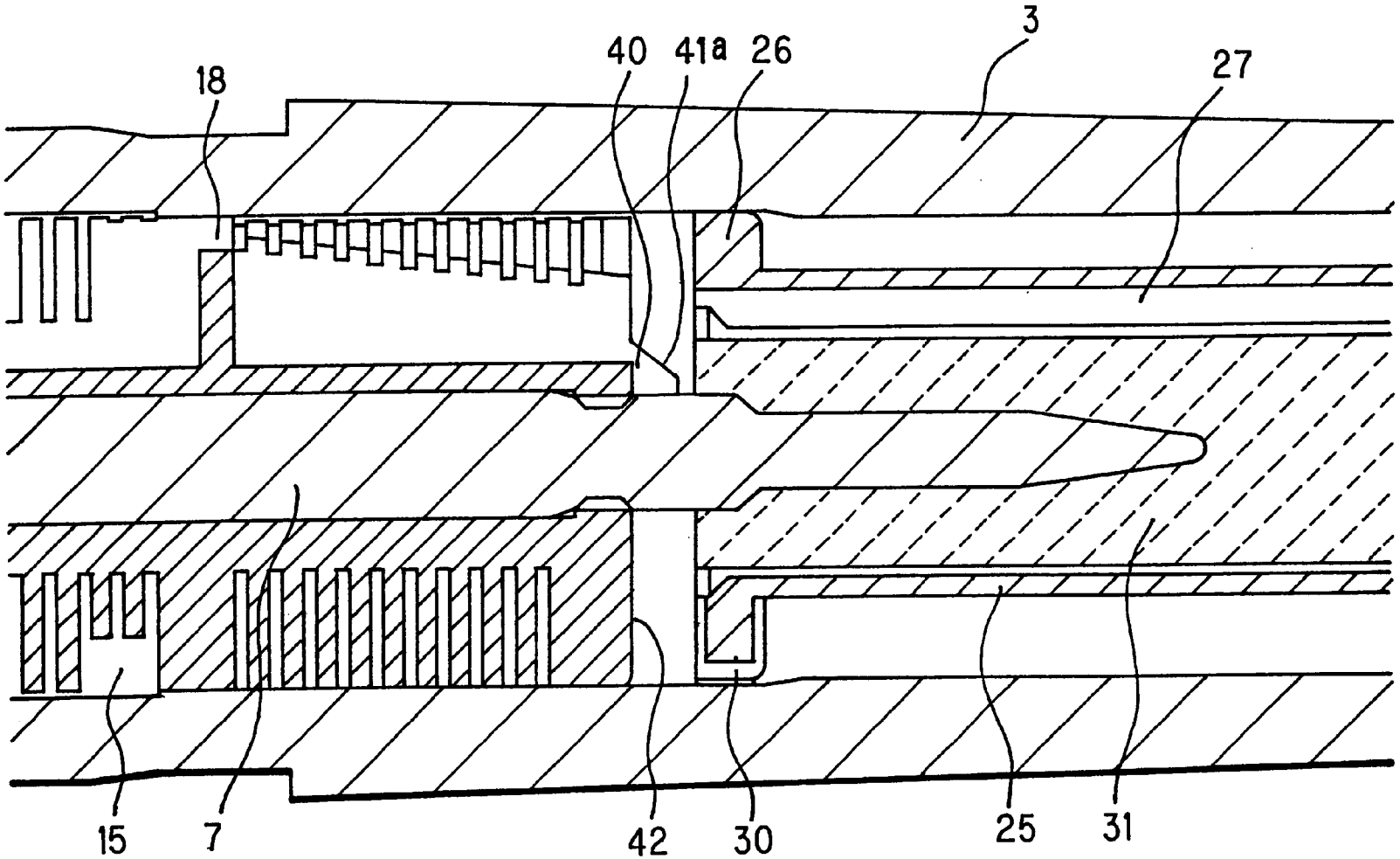
FIG. 6 is an enlarged vertical sectional view showing the center portion of a writing instrument according to the second embodiment of the present invention.

In this configuration, when ink 2 is about to leak forwards from point assembly 1, collector core 7 etc., must have been wetted enough with ink 2 so that ink 2 oozes out from its surface, hence ink 2 can also be led out to lead portion 39*a* which is connected to the collector core. The mechanism of preventing forward leakage is quite the same as that described above. This configuration is effective when a small-diametric ink absorber 31 is used or other cases where the projecting portion cannot be practically inserted into ink absorber 31. Referring next to FIGS. 5 and 6 this will be described in detail.

The difference of the second embodiment of the present invention from the first embodiment resides in that lead portion 39*a* is arranged so as not to be in direct contact with ink absorber 31, and collector core 7 is interposed therebetween so that ink 2 can be led out from collector core 7.

Collector core 7 is connected with and inserted into ink absorber 31 so as to lead ink 2 required for writing to point assembly 1 and is also connected to lead portion 39*a* so as to deliver ink 2 thereto.

The lead portion 39*a* in this case is configured by providing projecting portion 41*a* having a lead channel 40 of a small enough gap so that the lead portion can be connected to collector core 7 by contact or via ink held by capillarity. This configuration with projecting portion 41*a* is able to establish a more reliable connection with collector core 7.

Figure 7:
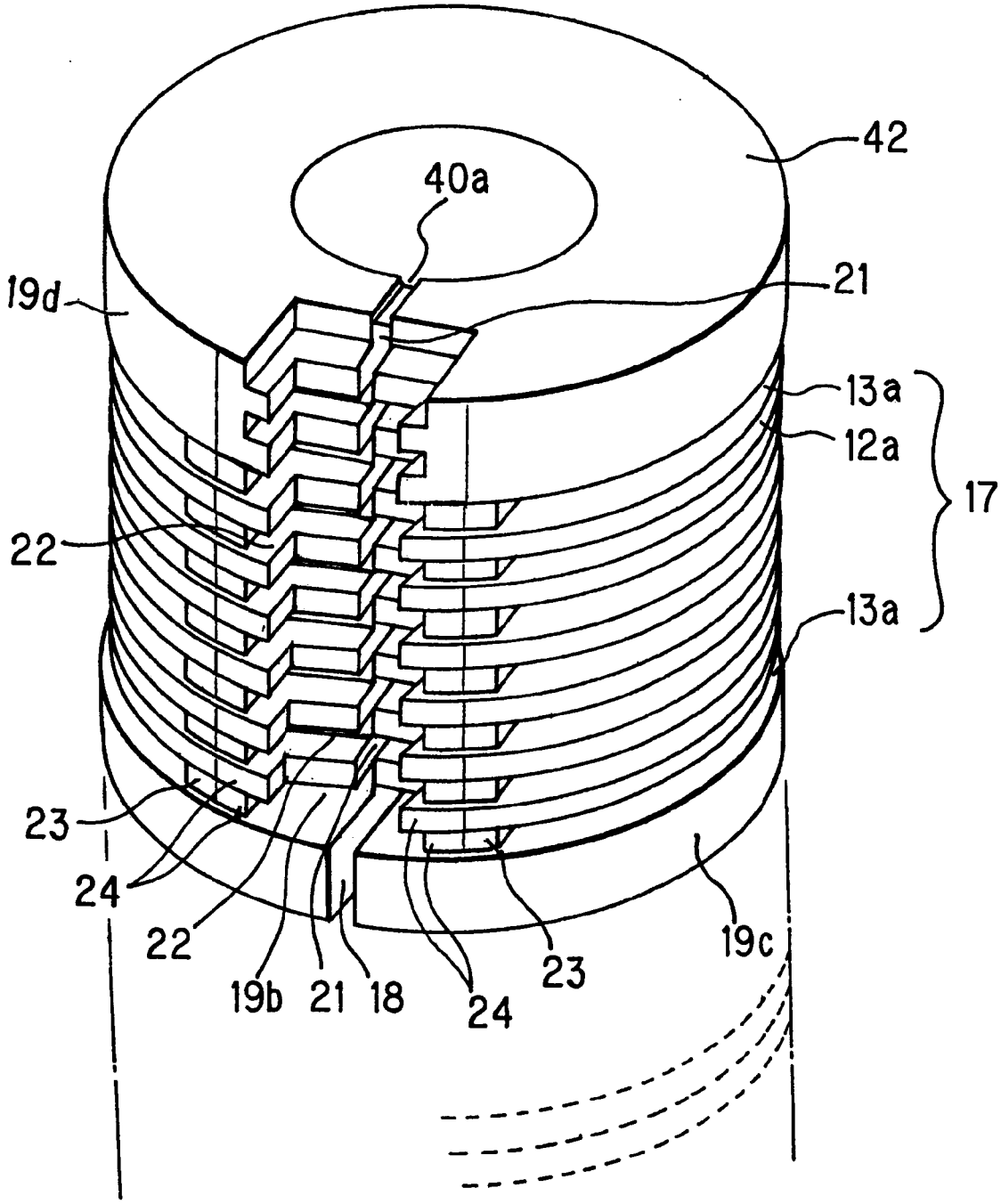
FIG. 7 is a perspective view showing auxiliary retaining grooves 17 portion of a collector of a writing instrument of another embodiment of the present invention.

It should be noted that lead channel 40 is not necessarily formed by the projecting portion 41*a*. As shown in FIG. 7, it is possible to create a channel 40*a* for leading ink 2 toward air/liquid exchanger 18, by incising the rear end part of the collector (collector's rear end face, for example). In FIG. 7, channel 40*a* is connected to air/liquid exchanger 18 via narrow groove 21.

Operation

Next, the operation of the present invention will be described.

The arrangement of the present invention not only provides the same function of conventional collector writing instruments, i.e., prevention against ink flooding when the internal pressure varies in a relatively gentle manner, but also provides the function of preventing ink 2 from abruptly flushing collector 6 from the ink tank 3 side, by reducing the volume of air expanding in tank 3 when an abrupt change in pressure occurs, in consideration of use on an airplane.

In the case of the above arrangement, when free-state ink 2 is used up and when ink 2 is stored virtually to fully 100% in ink absorber 31, ink head H applies on the point assembly 1 side so that forward leakage is liable to occur. However, since air/liquid exchanger 18 is constantly kept wetted with ink 2 of ink absorber 31, the forward leakage problem can also be solved.

Thus, this configuration is able to totally prevent accidents of collector writing instruments, including flooding and forward leakage.

Further, use of ink absorber 31 of a small size makes it is possible to solve the ink drop problem occurring when point assembly 1 is oriented upwards. Further, since presence of ink absorber 31 makes it possible to deliver a limited amount of ink at the end of writing life like a sliver type writing instrument does, this configuration is also able to solve the end of writing life problem or avoid the free-ink type writing instrument abruptly stopping writing.

Thus, the present invention provides the function of eliminating the occurrence of flooding and forward leakage in any possible usage situation of writing instruments until ink 2 usable for writing ends.

As described heretofore, the configuration and operation of the writing instrument of the present invention is thus provided, so it is possible to provide a writing instrument which is slim and stylish and excellent in cost performance.

It is also possible to suppress the occurrence of pumping phenomena resulting from capping, usage under varying pressure in an airplane and usage in an environment with change in temperature and hence secure the safe and stable writing performance. In particular, it is possible to provide a writing instrument, which is free from flooding and forward leakage problems which would have occurred under conditions in which increase and reduction in pressure is repeated, such as in an airplane, as experienced by a businessperson who writes while traveling and who takes multiple flights, and which is able to make the best use of the merits of collector type writing instruments.

Further, by the combination with the ink absorber, it is not only possible to further improve the safety margin against usual, moderate temperature variation but also solve the ink drop problem and the end of writing life problem at the same time.

Thus, this invention has the effective functions as described heretofore compared to conventional collector writing instrument and hence contributes to providing a safe collector writing instrument which is stylish and low in cost, can be easily manufactured and has a long shelf life.

In the above description of the embodiments, as the best mode, collector 6*a* equipped with auxiliary retaining grooves 17 is formed with projecting portion 41, 41*a,* lead channel 40 and channel 40*a*. However, it is possible to provide the same functions and effects by providing projecting portion 41, 41*a,* lead channel 40 and channel 40*a* in a collector 6 with no auxiliary retaining grooves 17.

Industrial Applicability

The present invention can be applied to collector writing instruments which can be used under a varying pressure environment in an airplane or under an environment in which temperature changes. In particular, the present invention can be applied to writing instruments which are used under conditions in which increase and reduction in pressure is repeated, such as in an airplane, as experienced by a businessperson who writes while traveling and who takes multiple flights.

What is claimed is:

1. A collector type writing instrument comprising:

a point assembly with a writing point at the tip thereof, an ink tank for storing a low viscosity ink in a free-state ink condition, an ink feeder portion formed of a center core, collector core or longitudinal groove, for leading ink from the ink tank to the writing point, and a collector disposed between the ink tank and the writing point as an adjuster element for storing ink via an air/liquid exchanger in its retaining portion utilizing capillarity when an inner pressure is adjusted, the writing instrument characterized in that:

an ink absorber capable of keeping ink therein is disposed inside the ink tank and connected to the center core, collector core or longitudinal groove as the ink feeder portion, the ink absorber having a length at least reaching to a position more rearwards than an approximate center of the ink tank and having an outside diameter that is sized to be smaller than an inside diameter of the ink tank so as to create a space around itself for permitting free-state ink to move freely, and the collector has a lead portion having a capillary capacity for establishing connection enabling ink to be led from the ink absorber to the air/liquid exchanger.

2. A collector type writing instrument comprising:

a point assembly with a writing point at the tip thereof, an ink tank for storing a low viscosity ink in a free-state ink condition, an ink feeder portion formed of a center core, collector core or longitudinal groove, for leading ink from the ink tank to the writing point, and a collector disposed between the ink tank and the writing point as an adjuster element for storing ink via an air/liquid exchanger in its retaining portion utilizing capillarity when an inner pressure is adjusted, the writing instrument characterized in that:

an ink absorber capable of keeping ink therein is disposed inside the ink tank and connected to the center core, collector core or longitudinal groove as the ink feeder portion, the ink absorber having a length at least reaching to a position more rearwards than an approximate center of the ink tank and having an outside diameter that is sized to be smaller than an inside diameter of the ink tank so as to create a space around itself for permitting free-state ink to move freely, the collector has a lead portion for establishing connection enabling ink to be led from the ink absorber to the air/liquid exchanger, and the lead portion of the collector is configured of a projecting portion directly inserted into and connected with the ink absorber and a lead channel formed on the projecting portion.

3. A collector type writing instrument comprising:

a point assembly with a writing point at the tip thereof, an ink tank for storing a low viscosity ink in a free-state ink condition, an ink feeder portion formed of a center core, collector core or longitudinal groove, for leading ink from the ink tank to the writing point, and a collector disposed between the ink tank and the writing point as an adjuster element for storing ink via an air/liquid exchanger in its retaining portion utilizing capillarity when an inner pressure is adjusted, the writing instrument characterized in that:

an ink absorber capable of keeping ink therein is disposed inside the ink tank and connected to the center core, collector core or longitudinal groove as the ink feeder portion, the ink absorber having a length at least reaching to a position more rearwards than an approximate center of the ink tank and having an outside diameter that is sized to be smaller than an inside diameter of the ink tank so as to create a space around itself for permitting free-state ink to move freely, the collector has a lead portion for establishing connection enabling ink to be led from the ink absorber to the air/liquid exchanger, and the lead portion of the collector is configured of a projecting portion and a lead channel formed on the projecting portion in such an arrangement that the projecting portion is, instead of being directly inserted to or connected with the ink absorber, connected to the center core, collector core or longitudinal groove as the ink feeder portion that is connected to the ink absorber, at least between the air/liquid exchanger of the collector and the ink absorber.

4. The collector type writing instrument according to claim 1, wherein the lead portion of the collector is formed by providing a lead channel having a small enough gap in a rear end part of the collector.

* * * * *